US008632130B2

(12) United States Patent
Costaglia

(10) Patent No.: US 8,632,130 B2
(45) Date of Patent: Jan. 21, 2014

(54) CHAIR-SPECIFIC ADJUSTMENT DEVICE

(75) Inventor: Massimo Costaglia, Santa Giustina in Colle (IT)

(73) Assignee: L & P Property Management Company, South Gate, CA (US)

( * ) Notice: Subject to any disclaimer, the term of this patent is extended or adjusted under 35 U.S.C. 154(b) by 275 days.

(21) Appl. No.: 12/779,652

(22) Filed: May 13, 2010

(65) Prior Publication Data

US 2011/0278893 A1 Nov. 17, 2011

(51) Int. Cl.
*A47B 97/00* (2006.01)
*A47C 31/00* (2006.01)

(52) U.S. Cl.
USPC ..... 297/463.1

(58) Field of Classification Search
USPC ..... 297/313, 302.1, 300.1, 463.1, 325, 326, 297/327, 328, 344.12
See application file for complete search history.

(56) References Cited

U.S. PATENT DOCUMENTS

| | | | | |
|---|---|---|---|---|
| 3,612,604 | A | 10/1971 | Meinhardt | |
| 4,666,121 | A | 5/1987 | Choong et al. | |
| 4,718,726 | A * | 1/1988 | Estkowski et al. | 297/313 |
| 5,651,584 | A | 7/1997 | Chenot et al. | |
| 6,932,430 | B2 | 8/2005 | Bedford et al. | |
| 7,147,285 | B2 * | 12/2006 | Lin | 297/301.1 |
| 7,815,257 | B2 * | 10/2010 | Costaglia et al. | 297/303.5 |
| 2003/0015902 | A1 * | 1/2003 | Knoblock et al. | 297/300.1 |
| 2005/0236878 | A1 | 10/2005 | Rossetto et al. | |
| 2006/0091715 | A1 | 5/2006 | Schmitz et al. | |
| 2006/0255636 | A1 | 11/2006 | Donati | |

FOREIGN PATENT DOCUMENTS

| | | | |
|---|---|---|---|
| DE | 4318516 | A1 | 12/1994 |
| EP | 0902634 | B1 | 5/2000 |
| IT | 225116 | Z2 | 9/1996 |
| IT | MI2005A000751 | | 2/2006 |
| WO | 9428769 | | 12/1994 |
| WO | 2008140777 | A2 | 11/2008 |

OTHER PUBLICATIONS

PCT Notification of Transmittal of the International Search Report and the Written Opinion of the International Searching Authority, or the Declaration, International filing date: May 12, 2011, International application No. PCT/US2011/036207, Applicant's or agent's file reference, Applicant: L&P Property Management Company.

* cited by examiner

*Primary Examiner* — Milton Nelson, Jr.
(74) *Attorney, Agent, or Firm* — Shook Hardy & Bacon LLP

(57) ABSTRACT

A chair-specific adjustment device is provided. The device includes a seat support and a base support linked to a gas column on which there is a rotating user-controlled handle. The handle controls the selection of the adjustment device's angular position as well as a safety limit clutch. The rotation of the handle generates traction of a tensional element that moves a limit switch. The limit switch runs transversely to the seat support and is shaped with steps that selectively interact with a limit appendage linked to the base support. The device includes a torsion bar that elastically limits the movement of the base support. As such, the device provides quick and easy adjustment of the backrest extension into various positions.

18 Claims, 15 Drawing Sheets

CHAIR-SPECIFIC ADJUSTMENT DEVICE

BACKGROUND

This application relates to a chair-specific adjustment device. Many devices are known today that control a specific inclination between a chair or an armchair's seat and backrest.

For example, German Patent No. DE 4,318,516 A1 (hereinafter "the '516 patent") is known, wherein a device is described that changes the reciprocal position between a chair's two mobile components. This device is comprised of a bolt engaging a gear adjacent to the body of a chair to lock it in the various different positions. The device can be defined as bi-stable, in the sense that it enables two different stable positions for the bolt. The bolt's movements are controlled by a device lodged in a container, the bolt is adjacent to a rod to which a pair of misaligned spindles are attached. A first spring acts between the rod and the container while a second spring, stronger than the previous one, acts between the container and the enlarged head of the pin.

The device of the '516 patent is activated by the user rotating a lever or cam, which presses on the pin's head; this rotation is applied on an axis perpendicular to the pin's; the lever is a precise, though not discreet, length in order to allow the user to apply, further to the effort applied in order to obtain the rotation, a sufficient axial push on the head, which becomes a drawback because of the resulting spatial arrangement imposed by the various components.

The solution described by the '516 patent presents many other drawbacks, as well as the overall structural complexity and the volume occupied by the single components, such as the need to apply a certain rotation strength on the lever to achieve the desired shifting in any case; this lever is also not particularly easy to activate, since the rotation force applied to the lever needs to translate into an axial push for the pin. Finally, the mechanical interaction between the bolt and the gear wheel is likely to get stuck.

Another example includes Italian patent for utility Model No. 225116, filed on Jul. 12, 1991 (hereinafter "the'116 patent"), which relates to an oscillating group for chairs with locking mechanism for various positions, where a device is described that interacts with a lever in order to lock it in different positions or release it, to allow or impede the oscillations of the oscillating support respectively, and the seating elements, with respect to the box body, along with it.

The device of the '116 patent is comprised of a maneuver lever that can rotate on its own axis, radially associated to a stiff tie-beam, with an end connected to said lever, and a locking element connected to the other end of the tie-beam. The locking element also rotates on its own vertical axis and moves towards and away from the lever arm, further to the rotation of the maneuver lever. There are springs that make the device basically bi-stable, in the sense that further to ensuing activations of the maneuver lever, it can ensure two corresponding stable positions.

This device also shows some drawbacks. It is made up by many components which are variably arranged in their seating and interconnections, thus making the production and assembly of the device costly. Also, the activation of the locking element is caused by actuating the lever, but this transmits the motion through the interposition of the stiff tie-beam, which can come loose or become deformed as a result of the applied forces. Additionally, the joint of the locking element creates further drawbacks, owed to the possible activation problems caused both to possible seizures or obstacles to the fluidity between elements, and to the force that needs to be exerted in order to overcome both the resistance of a spring and the friction between the lever arm and the locking element, a friction that becomes greater the longer the user is seated during the maneuver and therefore increases the coupling between the lever arm and the locking element.

Also known is the Italian patent for Industrial Invention, Application Publication No. ITMI20050751, filed on Apr. 27, 2005, illustrating an adjustment mechanism for the inclining of backrests in chairs and armchairs, especially office chairs, where backrest inclination controls are involved as well as spring mechanisms to bring the backrest towards its minimum inclination position.

These backrest inclination controls include at least one step limit group, one of the steps' tasks being to interfere with an element linked to the backrest during its reclining movements, as the limit group can be shifted into various discreet positions or the element linked to the backrest, in order to limit said element between the minimum reclining position and an interference position linked to the backrest with the chosen step in the group.

This solution also shows some drawbacks as the support for the backrest is connected to a lever which, as it needs to move longitudinally to the mechanism is subject to friction or getting stuck or deformations that could prevent its correct operation; also, the activation of the lever through the cam is not smooth, since the cam has to receive a rotary movement which, combined with the lever oscillation, must lead the pin to interact with one of the group steps, which is fixed, and so that could lead to further catching and incorrect positions.

Also, in the event of using a pinion, the latter needs to engage a rack to obtain a longitudinal movement that will make one of the steps available for the support extremity: in this case also there will be frictions between the various surfaces that can make the components' movement clumsy.

European Patent No. EP 0902634 (hereinafter "the '634 patent") is also known, claiming an Italian priority for the utility Model No. 242153, filed on Jan. 8, 1996, with Italian Patent Application No. VE96U000001, where a generic inclination adjustment device for chairs and armchairs is illustrated, characterized for its inclusion of a bolt that is part of the locking system and is fixed to one of the two parts of the seating support, a number of holes on the other side of the seating support in positions that can be engaged by the bolt and which correspond to the different reciprocal inclinations between the two parts of said support, an axial control stem of said bolt, an axially unstable device for the control of said stem, a couple of preloaded springs interplaced between said stem and said bi-stable device and a control button of said bi-stable device.

The solution of the '634 patent also presents many drawbacks: firstly, the device is activated with a button, which is usually placed next to a handle below the chair; this button isn't easy to reach. Also, the bolt is placed remotely compared to the button, so the stem is needed, which is lodged in its own sheath that lies between the bolt itself and the button needed for its activation. The presence of the sheath can also lead to a less than optimal activation of the bolt, as the stem cannot flow optimally when the button is activated within its sheath or in any case lead to a deformation of the same, which makes the push towards the bolt useless. Finally, in the mentioned technique, the positioning of the various components always appears discreet and so the user can choose between two positions that do not exactly correspond to the one they sought, but only come close.

SUMMARY

Embodiments of the invention relate to a chair-specific adjustment device, comprised of a first seat support and a base support linked to a gas column on which there is a first rotating user-controlled handle. The first handle controls the selection of the adjustment device's angular position and the safety limit clutch. The rotation of said first handle forces the traction of a first tensional element that moves, in contrast with a first elastically deformable element, a limit switch that runs transversely to said support and is shaped as steps that selectively interact with a limit switch linked to the abovementioned base support. The device includes a torsion bar that elastically limits the movement of said base support. This bar cooperates with means that regulate its tension. The device includes a second handle, aligned with the first handle, which engages a gas lifting device through a second tensional element.

Thus, in one aspect the invention allow for quickly, simply and with contained effort achieving backrest movement limitation adjustment to the various positions.

In another aspect the invention provides a device that allows the adjustment of a backrest's position acting, quickly and easily, on a handle that enables a user to achieve preset conditions, at the same time protecting the device from any breakages due to an incorrect handle activation.

Another aspect includes providing a device that contains, gradually, the forces applied by the backrest adapting automatically to the user's weight and therefore without the need to carry out complex manual adjustments should there be different users for the same chair with significantly different weights. Thus, the correct backrest support for a user is provided and achieved by a sort of auto-adjustment capacity of the device.

Another aspect of the invention provides an item that is structurally simple and compact, thus limiting the space it occupies.

In yet another aspect the device is capable of quick assembly and simple maintenance.

A further aspect includes providing a device that combines the previous characteristics with that of contained manufacturing costs and that can be manufactured with the usual known machinery and facilities.

The aspects described above, as well as others that will appear more clearly upon reading of this disclosure, are achieved through embodiments of the invention that include a chair-specific adjustment device, which comprises of a first seat support and a base support linked to a gas column. The device includes a first rotating user-controlled handle, which is characterized by the fact that said first handle controls the selection of the device's angular position and a safety limit clutch. The rotation of the first handle forces the traction of a first tensional element that moves a limit switch transversely to the support and is shaped as steps that selectively interact with a limit switch linked to the abovementioned base support. The device includes a torsion bar that elastically limits the movement of the secondary base support; this bar cooperates with means that regulate the tension thereof. The device includes a second handle, aligned with the first handle, that engages a gas lifting device through a second tensional element.

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

DESCRIPTION OF THE DRAWINGS

Illustrative embodiments of the invention are described in detail below with reference to the attached drawing figures, and wherein.

DETAILED DESCRIPTION

Figure 1:
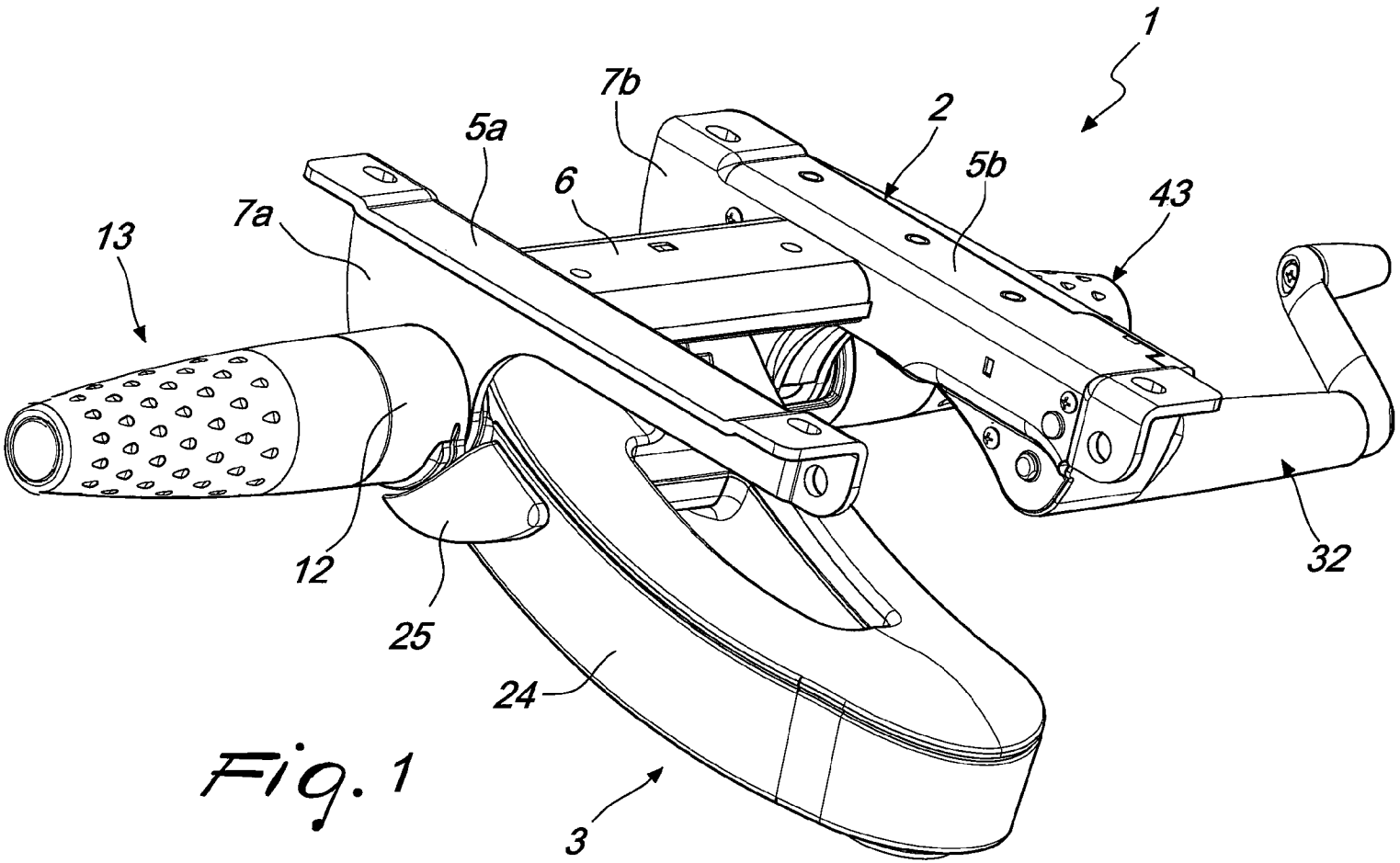
FIG. 1 illustrates a first axonometric view from above of a device in accordance with an embodiment of the invention.
Figure 2:
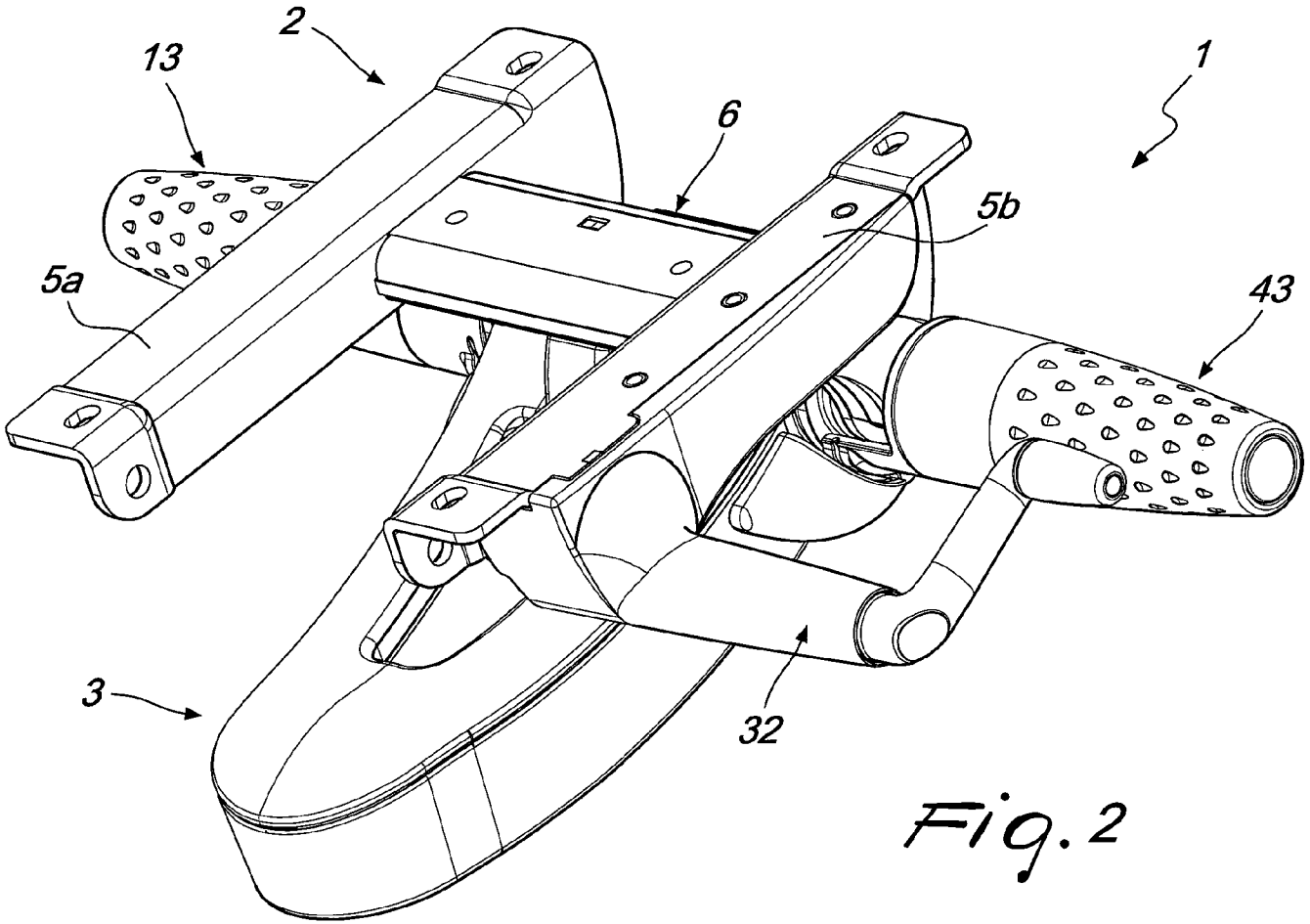
FIG. 2 illustrates a second axonometric view of a device in accordance with an embodiment of the invention.
Figure 3:
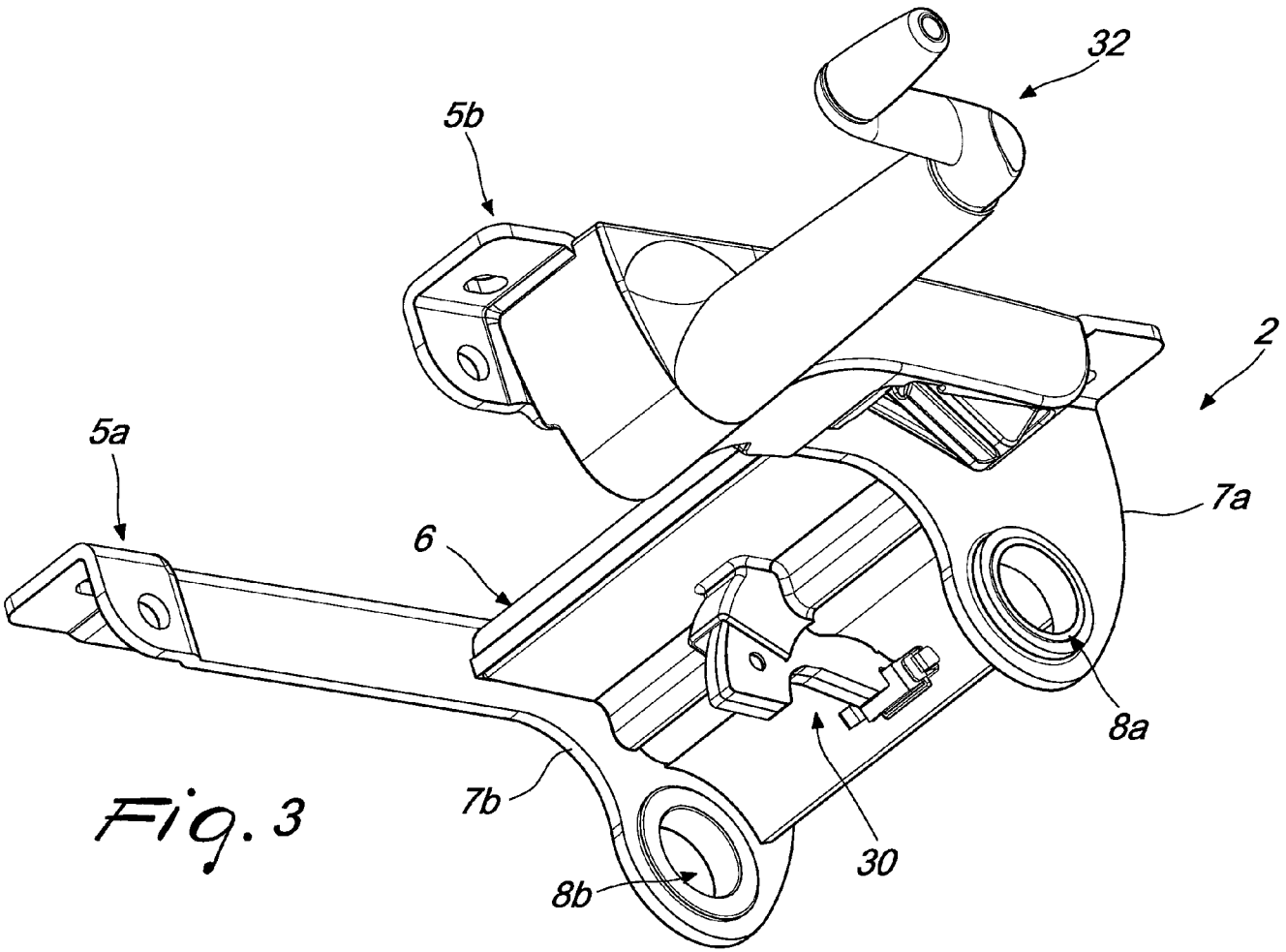
FIG. 3 illustrates part of a device in an axonometric view from below in accordance with an embodiment of the invention.
Figure 4:
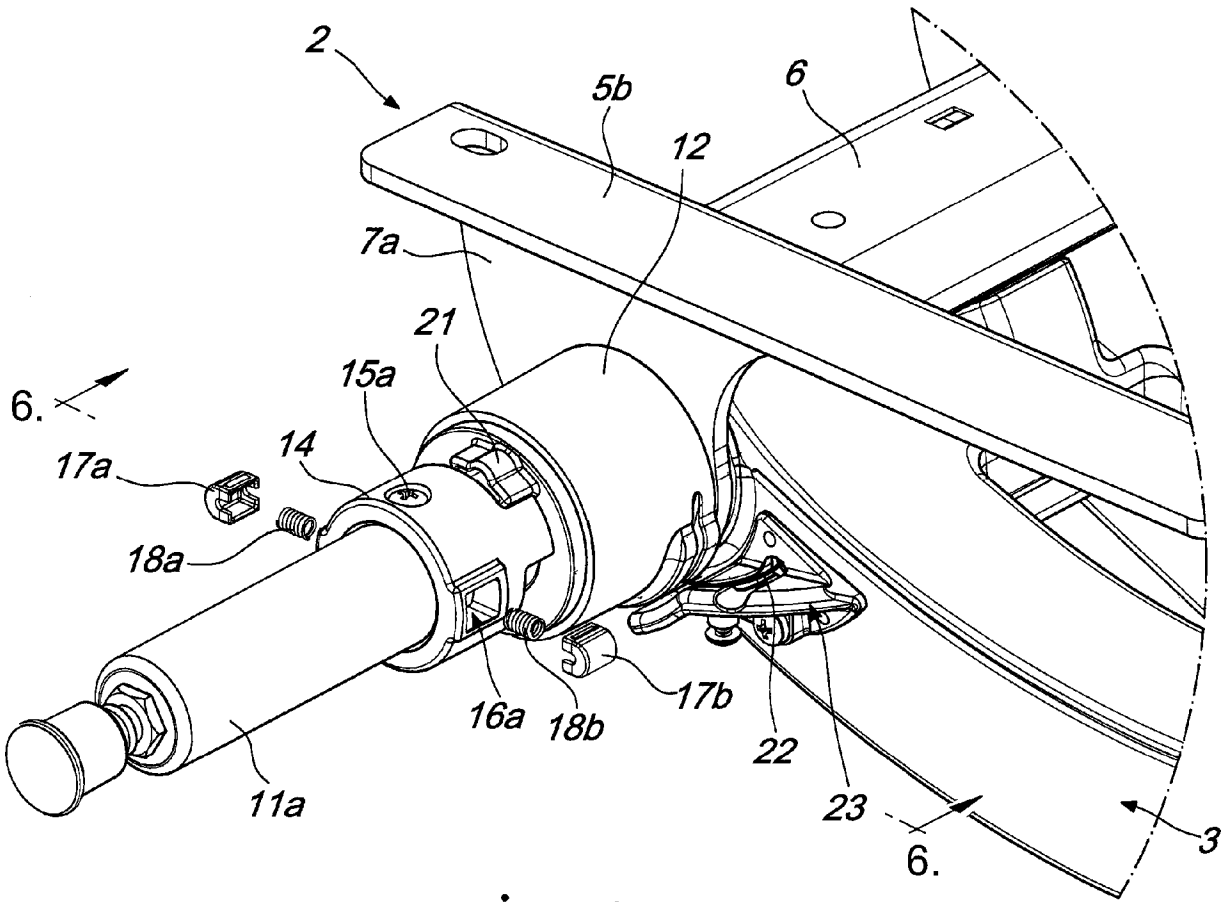
FIG. 4 illustrates a device in a detail where a handle is removed and one or more components are shown exploded in accordance with an embodiment of the invention.
Figure 5:
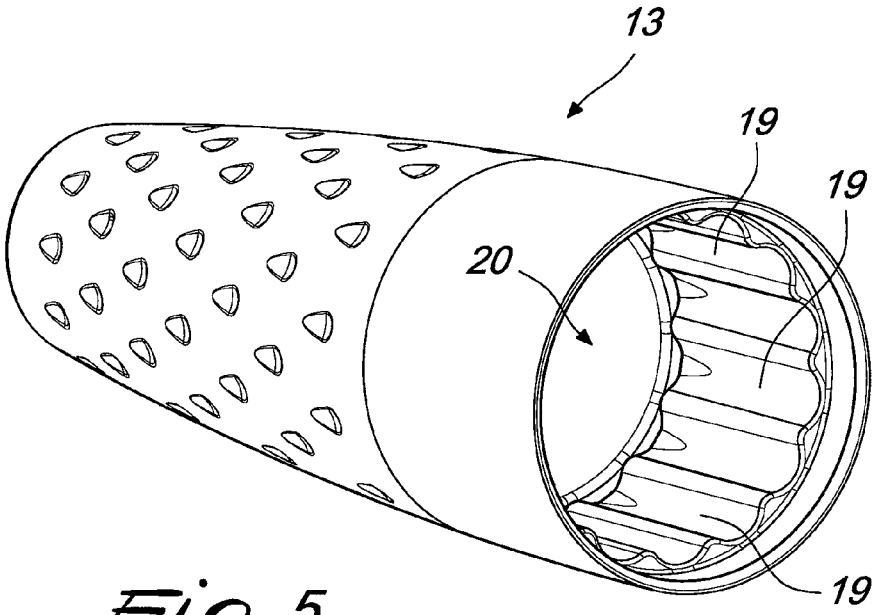
FIG. 5 further illustrates the handle illustrated in FIG. 4 in accordance with an embodiment of the invention.
Figure 6:
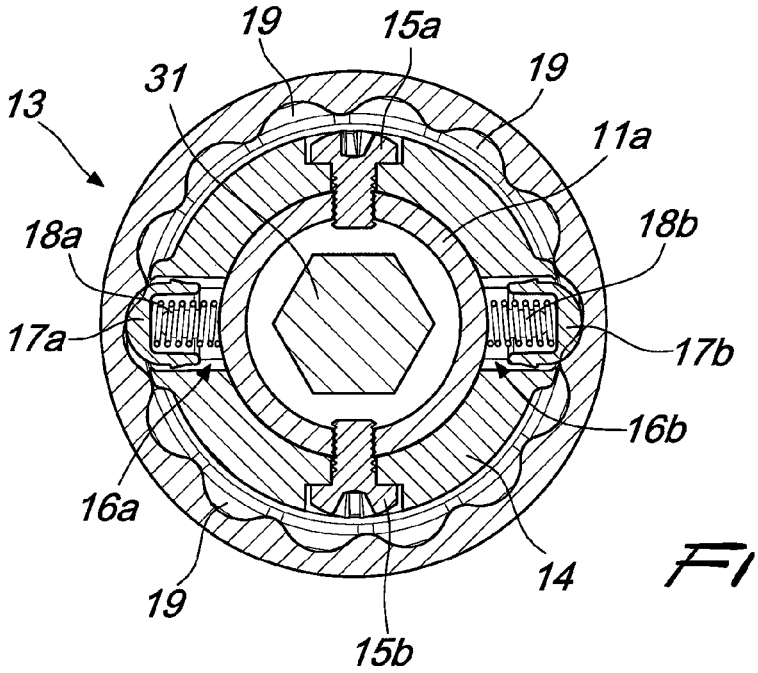
FIG. 6 depicts a cross-sectional view according to the section plane 6-6 of FIG. 4 and in which the components depicted in exploded arrangement in FIG. 4 are depicted in unexploded arrangement in accordance with an embodiment of the invention.
Figure 7:
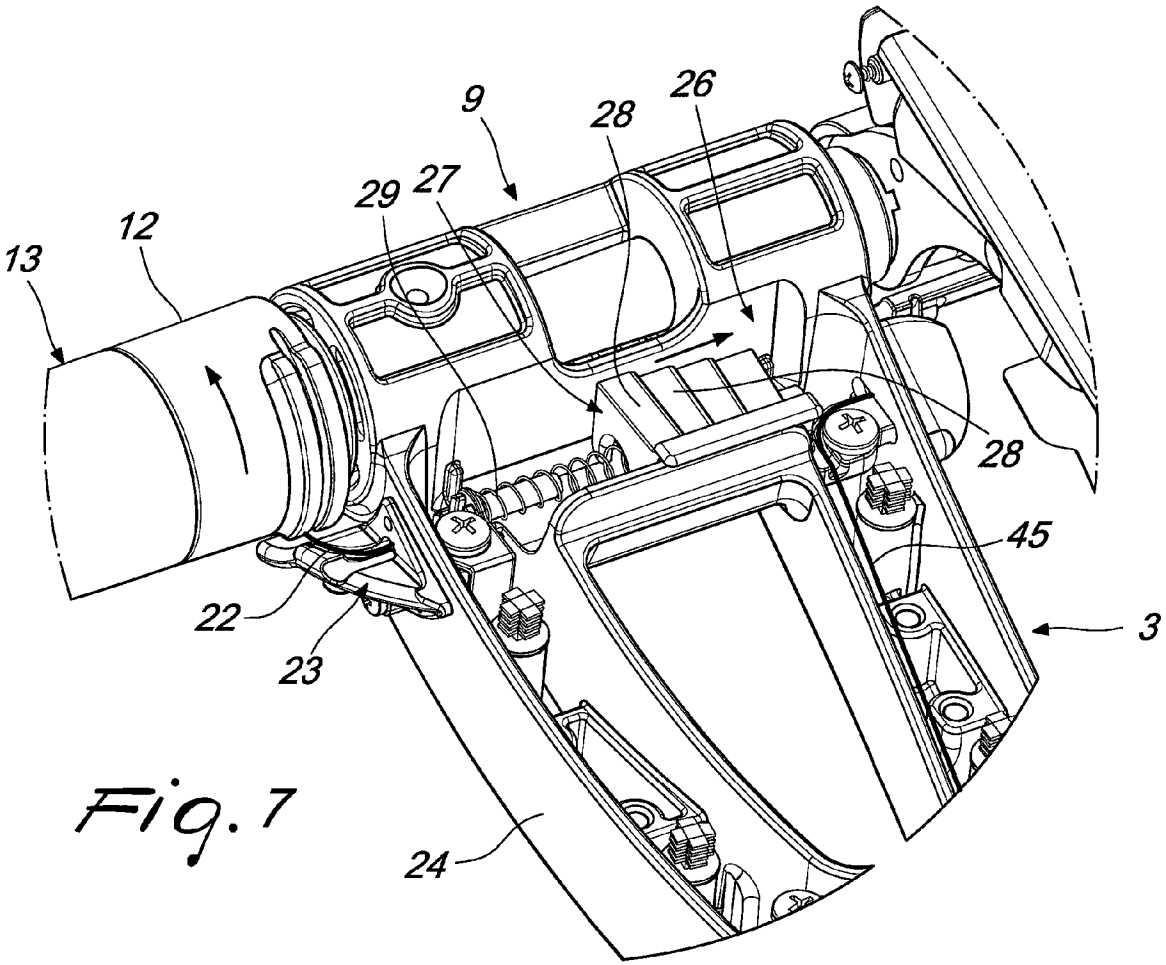
FIG. 7 illustrates a limit switch in a first minimal limitation position in accordance with an embodiment of the invention.
Figure 8:
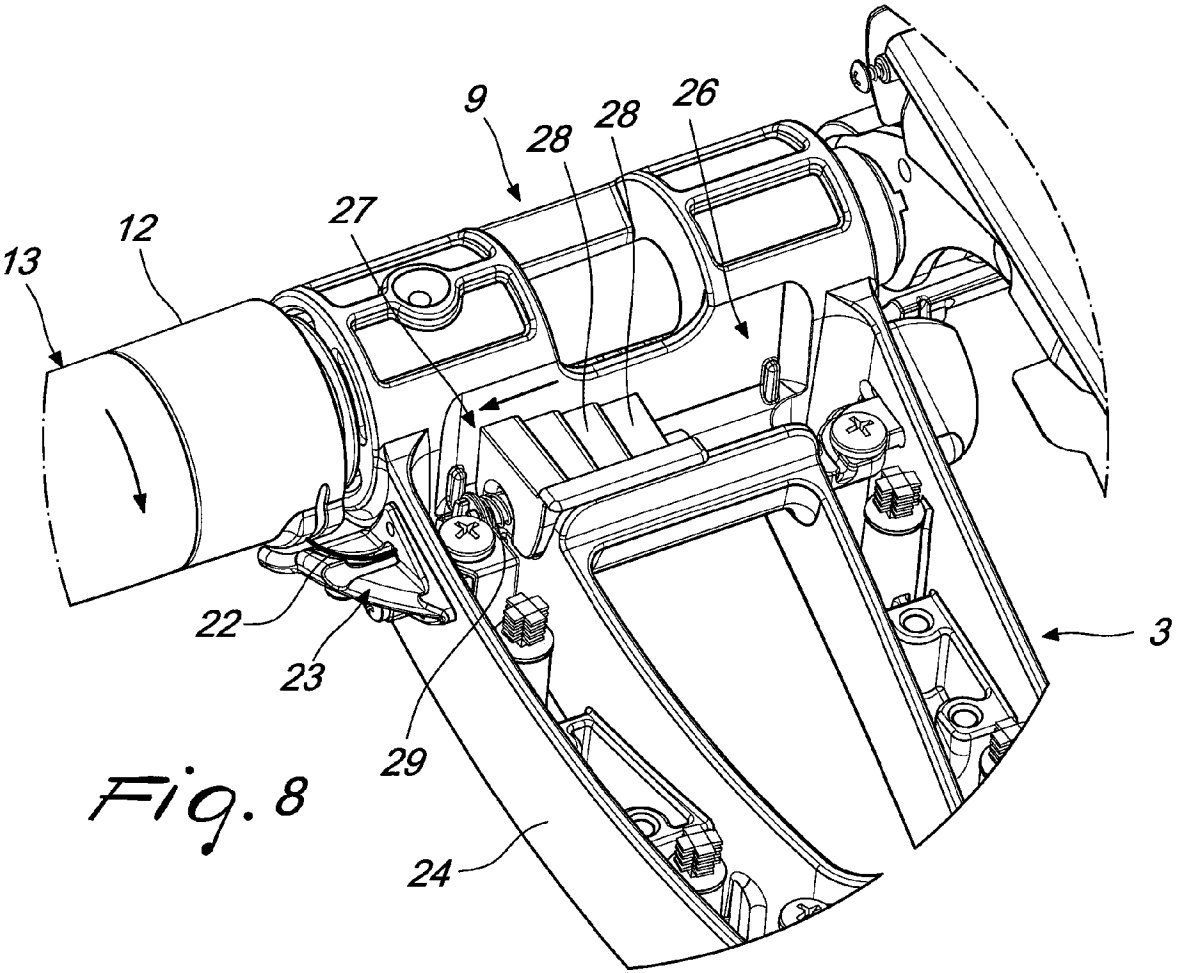
FIG. 8 illustrates a limit switch in a second maximum limitation position in accordance with an embodiment of the invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

With reference to the previously mentioned figures, number (1) indicates a chair-specific adjustment device, which includes a support (2) for a seat connected to a base support (3) that can be associated to a gas column, which is not illustrated, of a known type. In an embodiment, the device (1) can, in particular, be used for monocoque chairs with integrated seat and backrest.

The support (2) shows pair of wings (5*a*, 5*b*) joined by a first base (6) in an essentially U-shaped configuration. Next to the first base (6), protruding below the first wings (5*a*, 5*b*) a pair of appendages (7*a*, 7*b*) with the holes (8*a*, 8*b*), drilled along the same axis, near which the support (2) can rotate so as to take on different angles that allow different postures for the chair's user.

The base support (3) has a more or less triangular configuration and is next to a second base (9) that includes an essentially cylindrical shape. The second base (9) is associated by swivel, arranged by the interposition of sleeves (10*a*, 10*b*) arranged near the holes (8*a*, 8*b*), to a pair of first cylindrical shafts (11*a*, 11*b*), each of which protrudes beyond the terminal ends with the first appendages (7*a*, 7*b*).

A first shaft (11*a*, 11*b*) for an appendage (7*a*) is placed coaxially to a first terminal (12), close to a first handle (13) presenting means for the selection of its angular position and means of safety for the friction limit condition.

The means for the selection of angular position are comprised of a first ring (14) placed coaxially to the first shaft (11*a*) near the first terminal (12), this first ring (14) being made integral with the first shaft (11*a*) through screws (15*a*, 15*b*) arranged along the same diameter axis on the first ring (14).

The first seats (16*a*, 16*b*) for a pair of switches (17*a*, 17*b*) are obtained on an axis rotated approximately 90° on that first ring (14), slideably associated in contrast with a pair of first springs (18*a*, 18*b*).

Switches (17*a*, 17*b*) are forced to extend beyond the outer lateral surface of the first ring (14) and selectively interact with the counterblock second seats (19) obtained on an axially inner lateral surface (20) of the first handle (13) at its free end.

The inner lateral surface (20) has a diameter about equal to the exterior of the first ring (14), and, thanks to the switches (17*a*, 17*b*), is coupled to the first ring (14) positioned close to the first terminal (12). With switches (17*a*, 17*b*) a selective and discreet positioning of the first handle (13) can be obtained according to a precise and desired number of positions.

The first terminal (12) is made integral in rotation with the first handle (13), while it is neutral with respect to the first shaft (11*a*), due to a protrusion (21) projecting axially to the first terminal (12) and shaped so as to be positioned between the second seats (19).

The rotation of the first handle (13) thus leads to the rotation of the first terminal (12); this rotation clicking through the interaction of the switches (17*a*, 17*b*) with the various second seats (19).

The protrusion (21) is elastically deformable to define a non-rigid but elastic connection with the first handle (13). As such, if a user rotates the first handle (13) too much one way or the other and should the first terminal (12) not be able to rotate (it will be shown later what the rotation of the first terminal (12) acts upon), there will be an elastic deformation of the protrusion (21), which therefore achieves a further rotation of the first handle (13) moving from the interaction with a second seat (19) to that nearby. In this sense, the first handle (13) can then rotate even if the first terminal (12) is prevented in the rotation, thereby maintaining the integrity of the device (1).

The friction safety means, especially for the limit switch condition, are immediately perceived, when activated, by the user, who can hear the sound of the protrusion's (21) empty snap from one second seat (19) to the next one. As such, the user understands that he or she must reverse the direction of the rotation, having arrived at the limit.

Coaxially to the first terminal (12) a first element of tension (22) is partially wrapped as a cable at one end made integral with the first terminal (12) itself. The rotation imposed on the first handle (13) and then on the first terminal (12) requires, preferably in a clockwise rotation, the traction of the cable (22) which interacts with a guide (23) protruding from a side wall (24) of the base support (3) in an area adjoining the first appendage (7*a*) for the first terminal (12).

This guide (23), concealed by a first cap (25), sends the cable (22) to a nearby third seat (26) obtained across the base support (3) in an area adjoining the second base (9). Within this third seat (26) a stroke limiter (27) is slideably positioned, consisting of a rectangular element whose lateral surface facing the first wings (5*a*, 5*b*) of the support (2) for the seat present a stepped configuration (28) decreasing in the direction extending from the first appendage (7*a*) to the second appendage (7*b*) of the support (2). The number of steps and their size can vary depending on specific needs. In one embodiment, four steps are provided.

The sliding stroke limiter (27) in the third seat (26) works in contrast with a second spring (29) which works in compression. When the first handle (13) is rotated counterclockwise, for example, release of the first element of tension (22) is obtained and, thanks to the thrust of the second spring (29), the stroke limiter (27) is forced to move in an opposite direction to the first terminal (12).

The steps of the stepped configuration (28) stroke limiter (27) interact selectively with a limit (30) which consists of a hammer-shaped appendage protruding internally and under the first base (6) of the support (2) for the seat.

This limit (30) is preferably positioned in a middle zone of that first base (6) so as to interact, regardless of the location of the stroke limiter (27), with at least one of the steps of the stepped configuration (28) on the same, so as to achieve a different and desired angle of the support (2) compared to the second support (3).

Figure 9:
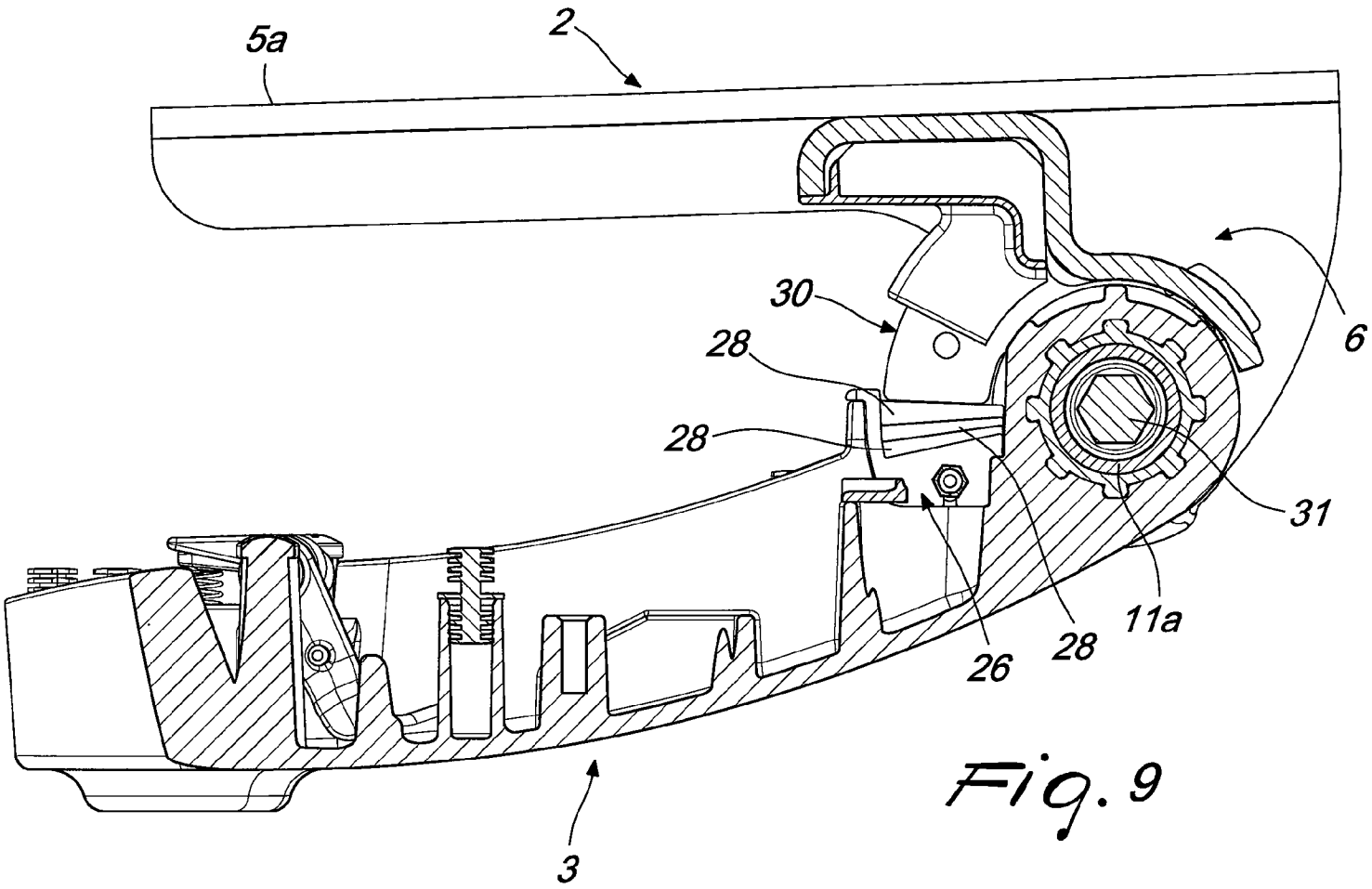
FIG. 9 illustrates a cross-sectional view of the device illustrated in FIG. 7 viewed from a cross-sectional plane through the limit switch in accordance with an embodiment of the invention.
Figure 10:
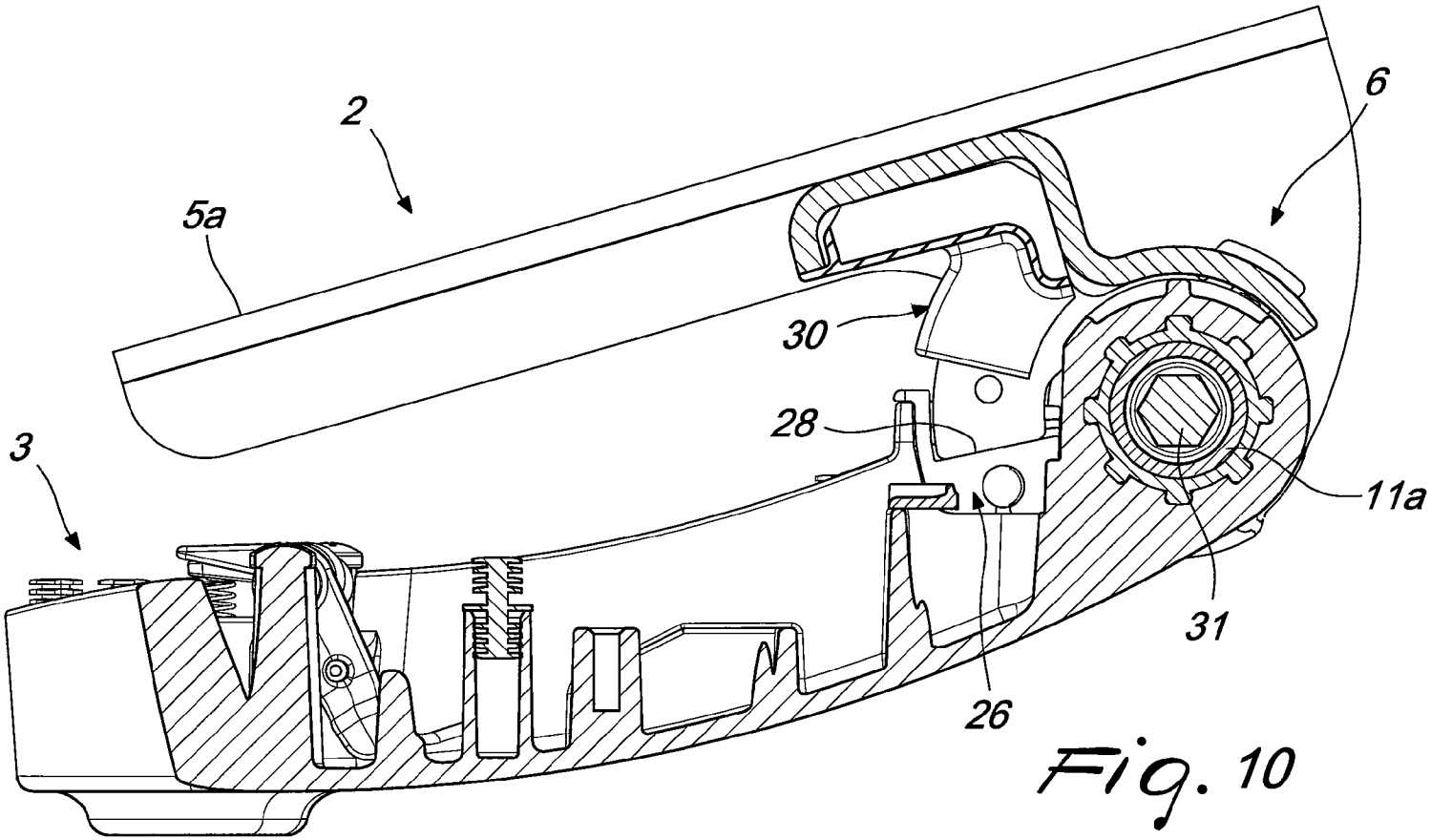
FIG. 10 illustrates a cross-sectional view of the device illustrated in FIG. 8 viewed from a cross-sectional plane through the limit switch in accordance with an embodiment of the invention.
Figure 11:
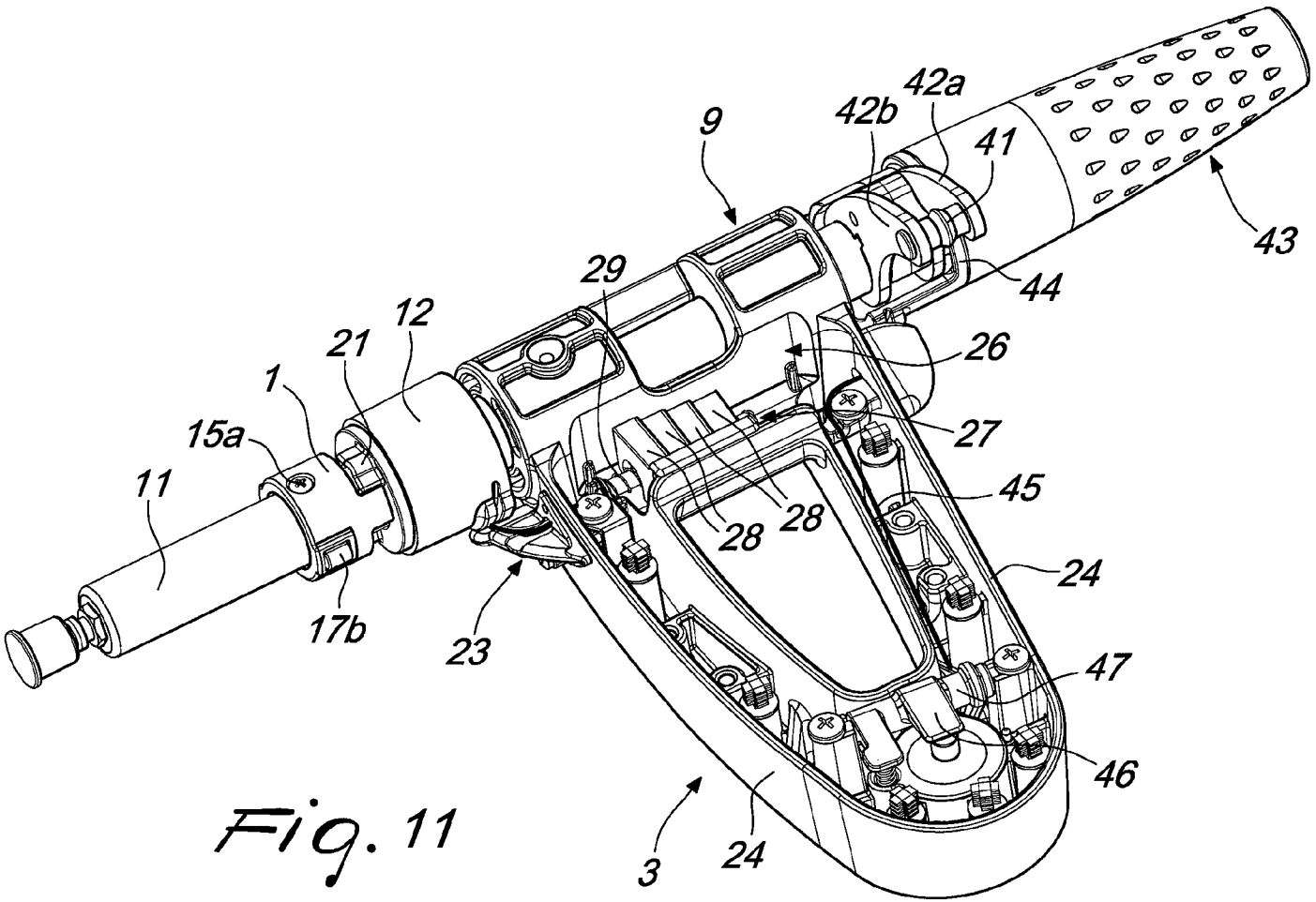
FIG. 11 illustrates, in a further axonometric view from above of a partially opened device where a limit switch is highlighted and a handle is partially removed in accordance with an embodiment of the invention.

FIGS. 9 and 10 show a maximum and a minimum limitation of the support's (2) swing for the seat against the base support (3).

The device also includes a torsion bar (31) to elastically limit the stroke of the base support (3). This torsion bar (31) is tied at one end of the first shaft (11*a*) that supports the first handle (13), and the other end is tied to the first shaft (11*b*) which is in turn associated by swivel to the sleeve (10*b*) placed at the hole (8*b*) drilled on the appendage (7*b*).

The torsion bar (31) cooperates through means of adjustment of its tension, said means covering a crank (32) associated with a rotating second pair of appendages (33*a*, 33*b*) protruding perpendicular and below the free terminal extremities of the first wing (5*b*) of the support (2) for the seat.

The crank (32) has, in the space between the second appendages (33*a*, 33*b*), a worm gear (34) which interacts with a gear (35) placed across the top and across the worm gear (34).

The gear (35) is swivel-hinged in correspondence of a prepared plate (36) connecting the second appendages (33*a*, 33*b*). This gearing (35) presents an axially threaded shank (37) protruding toward the first base (6) and interacting with a slider (38) associated slideably with a second guide (39) obtained lower and axially to the first wing (5*b*).

The slider (38) can thus make a movement away from the plate (36) towards the first base (6) following a rotation imposed on the crank (32); said slider (38) presents, at the opposite end of that adjacent to the plate (36), an inclined surface (40) that forms, with respect to the plane of position of the first wing (5*b*), an acute angle whereby a clockwise rotation is the positive.

Figure 12:
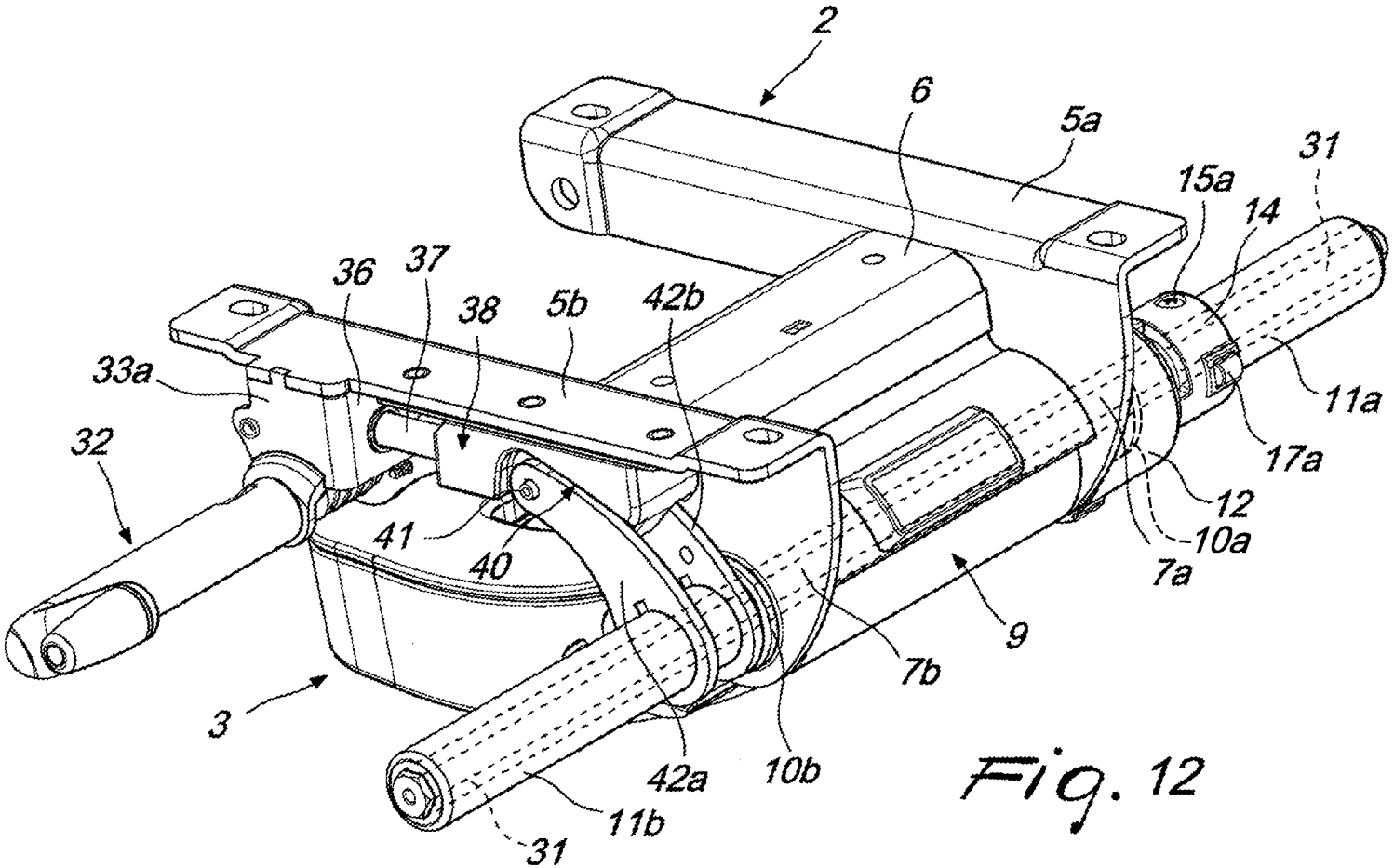
FIG. 12 illustrates a axonometric view from behind of a device with handles and some coverings removed in accordance with an embodiment of the invention.
Figure 13:
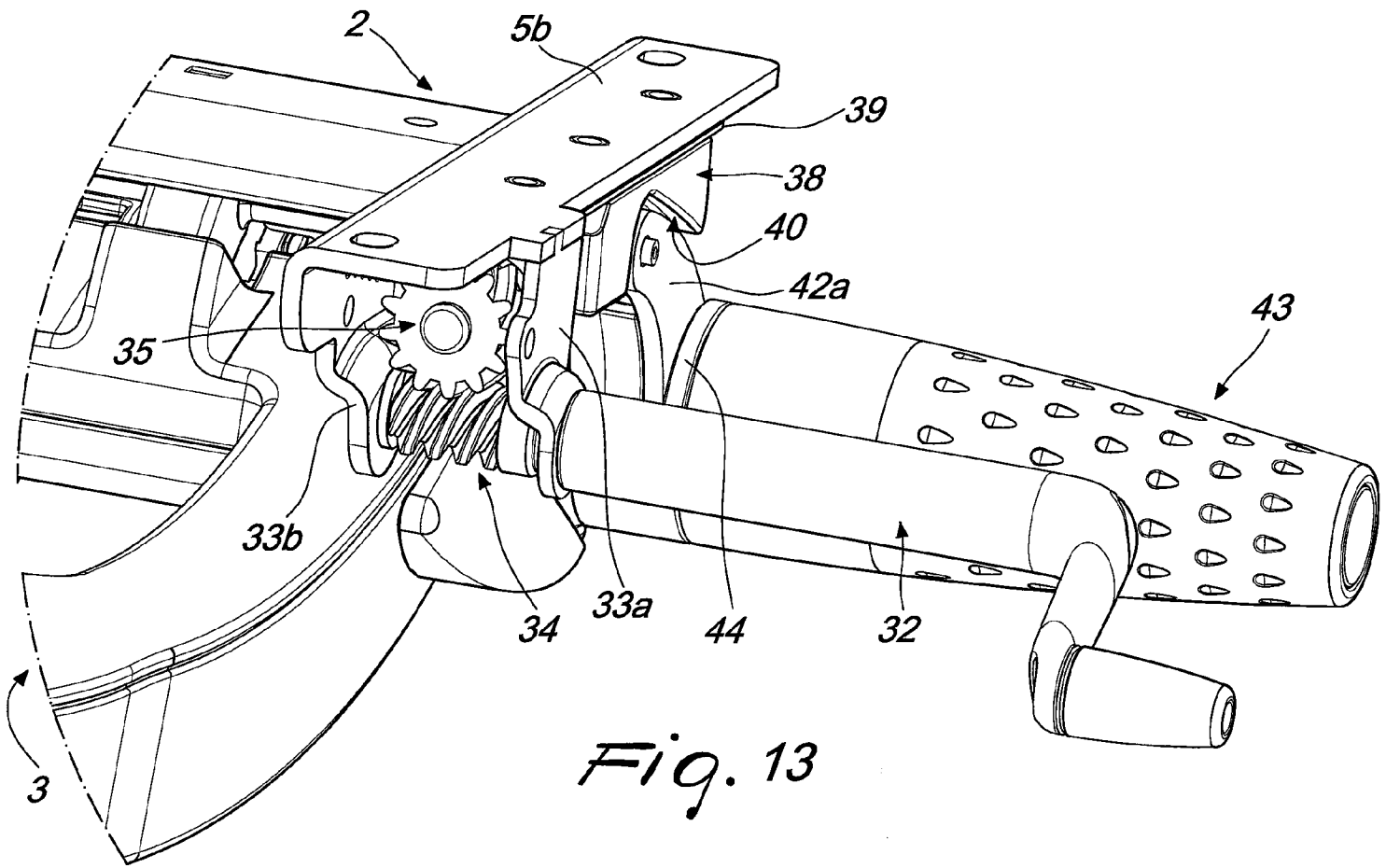
FIG. 13 illustrates a detail of a crank for the preloading of a torsion bar in accordance with an embodiment of the invention.
Figure 14:
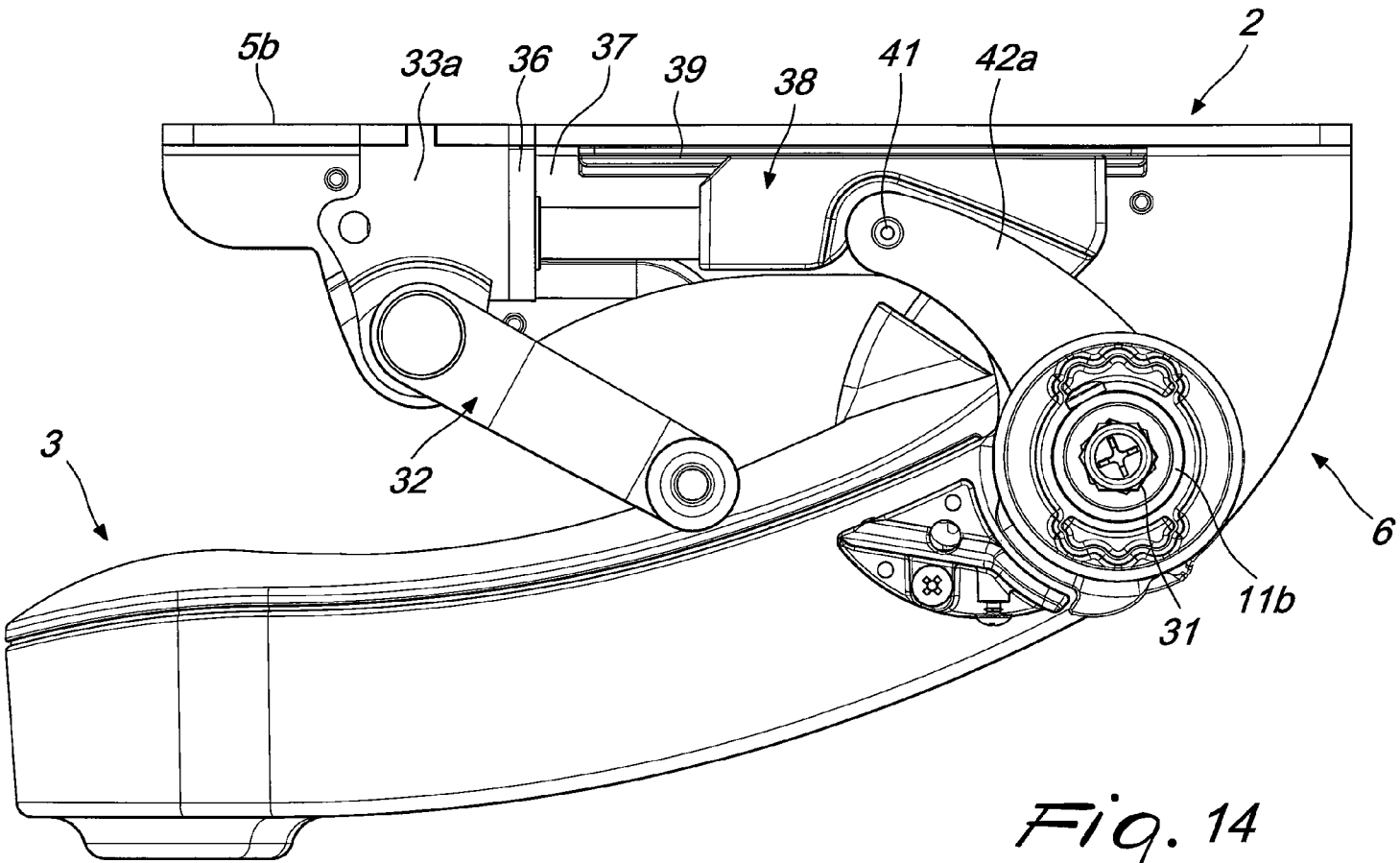
FIGS. 14 and 15 illustrate a device in a partially sectioned side view and with various components removed in order to highlight a torsion bar preloading condition in accordance with an embodiment of the invention.
Figure 15:
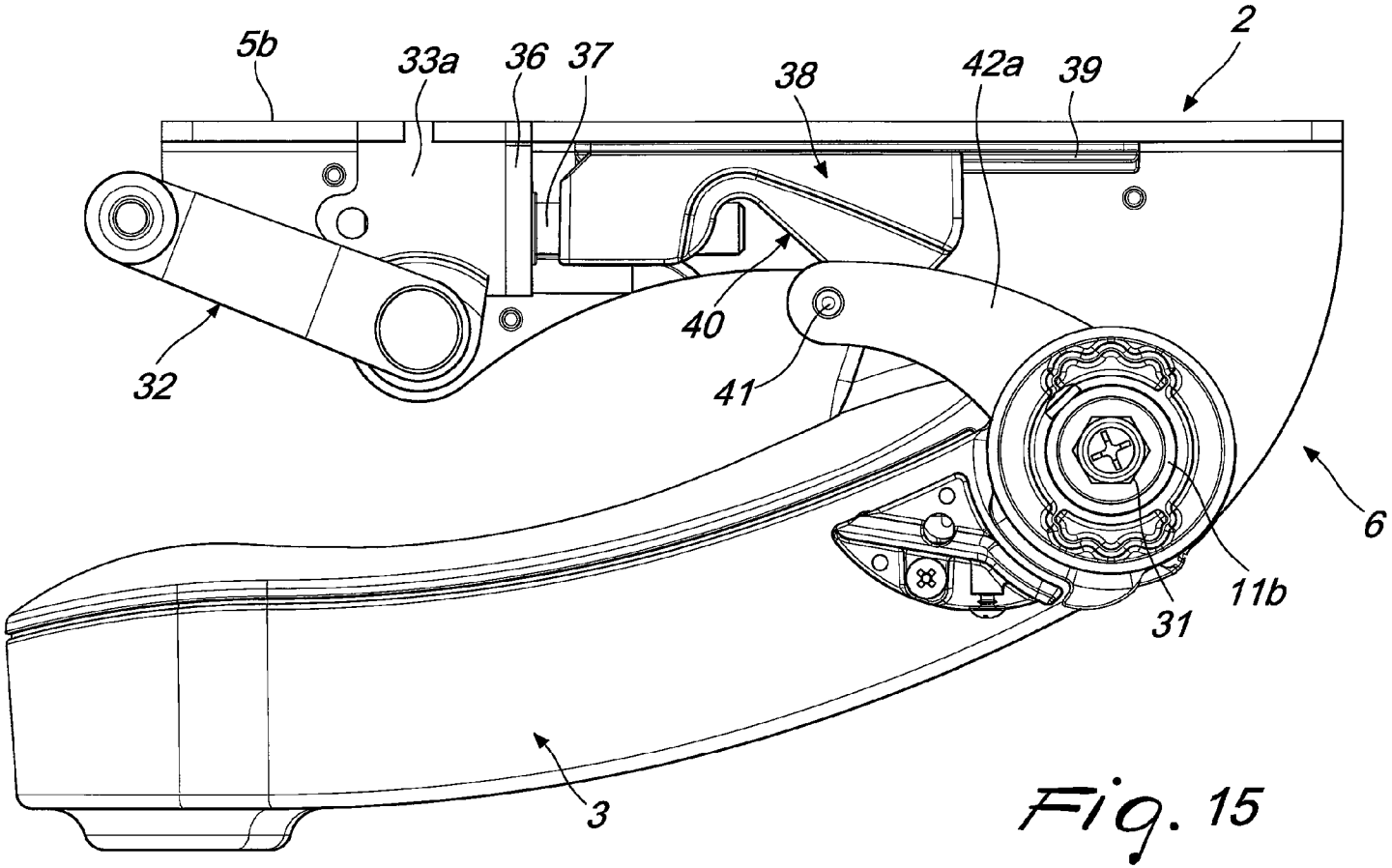
Figure 16:
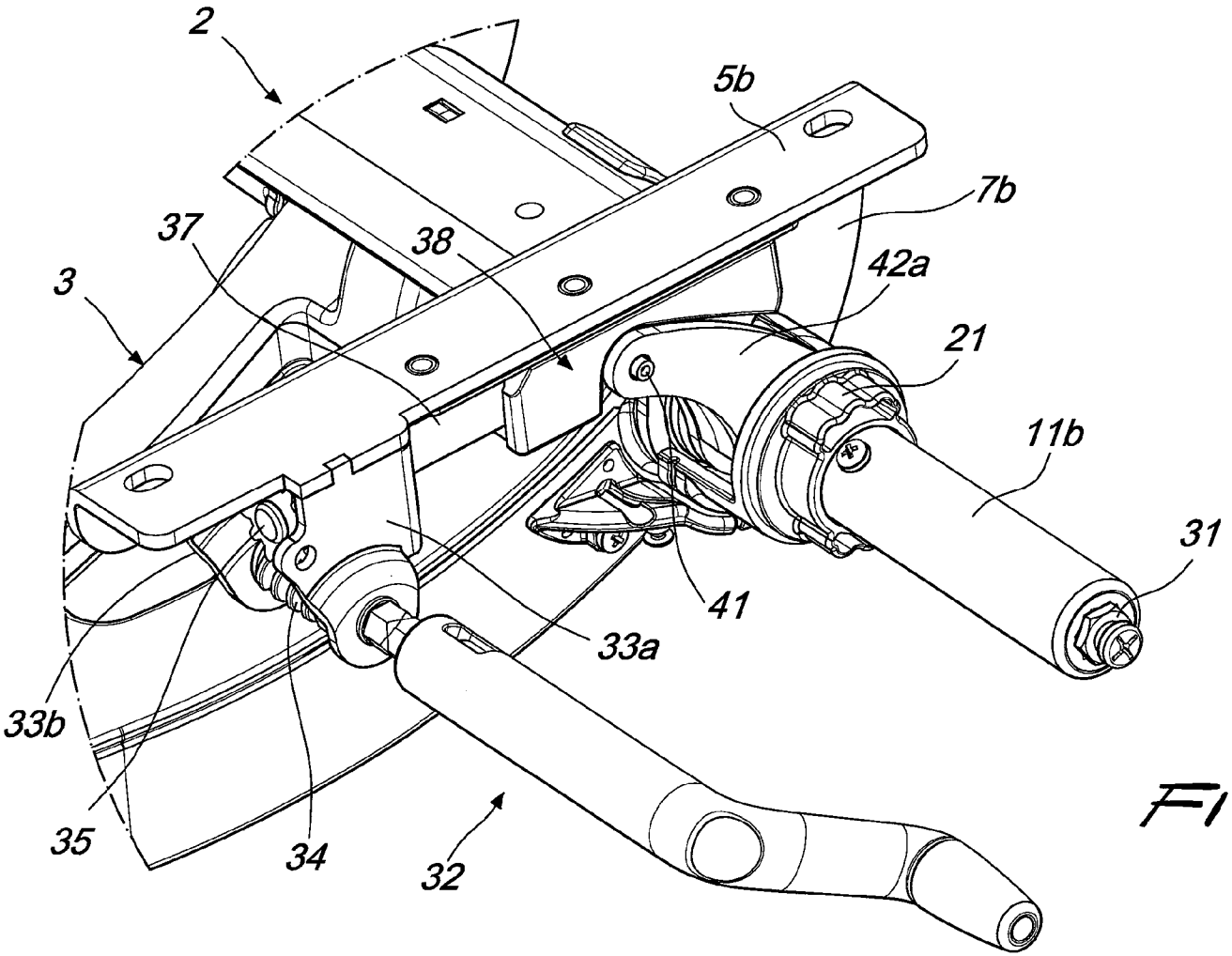
FIG. 16 illustrates an axonometric view from above of some of a device's components from the side of a second handle in accordance with an embodiment of the invention.

Under the sloping surface (40) a pin (41) is slideably placed and then placed transversely to the inclined surface (40) and connected at the ends of a third pair of appendages (42*a*, 42*b*) having a curved shape and the other end made coaxially integral to the first shaft (11*b*), as shown in FIG. 12).

The shape of the inclined surface (40) determines a rotation of the third appendages (42*a*, 42*b*) which, being fixed to the first shaft (11*b*), cause a preload to the torsion bar (31), thereby obtaining a desired adjustment of the thrust of the support (2) for the seat.

Said means for adjusting the torque of the torsion bar are structurally very simple, with no stiffness and can be adjusted very easily and quickly by simply activating the crank (32). Moreover, the effort to drive the crank by a user is minimized compared to other devices in the art. The crank (32) may also advantageously be of telescopic type and thus be extracted and further facilitate its use.

The device (1) also includes a second handle (43) that is associated with the first rotating shaft (11*b*) and has a structure similar to that of the first handle (4) coupled with a second ring (44), coaxial to the first shaft (11*b*) and integral in rotation with the third appendage (42*a*). The second ring (44) also presents a protrusion (48) for coupling to the second handle (43), which acts as a safety clutch for the limit condition.

The second handle (43) permits, upon its rotation, the activation of a second element of tension (45) as a second cable which is pushed back, like the first cable (22), to the adjacent side wall (24) of the base support (3) and connected at the other end to a lifting device consisting of a gas bar (46) which is made to swing through the second cable (45) and which leads it to interact with an underlying throttle (47).

Accordingly, embodiments of the invention deliver, quickly, easily and with contained efforts, the adjustment of the backrest extension into various positions, this being permitted by quick and easy activation of the first handle, which enables the user to achieve preset conditions while protecting the device from possible breakage due to an incorrect activation of the handle. Embodiments of the invention also allow gradual containment of the force exerted by the backrest, adjusting automatically to the user's weight and therefore without the need to perform complex manual adjustments in case there are several users in the same chair with significantly different weights, thereby ensuring constant proper backrest support to the user and thus achieving a kind of self-regulation capability of the device (1).

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An adjustment device for extending a backrest of a chair, the adjustment device comprising:

a seat support;

a base support coupled to the seat support and comprising a base portion that is aligned with the seat support;

a rotating user-controlled first handle adapted to control selection of an angular position of the adjustment device, wherein the rotation of the first handle generates traction of a first tensional element that moves with respect to a first elastically deformable element;

a stroke limiter that runs transversely to the base support, wherein the stroke limiter is provided with a stepped configuration that selectively interacts with a limit switch linked to the seat support;

a torsion bar that elastically limits the movement of said base support; and a second handle, aligned with said first handle, that engages a lifting column through a second tensional element.

2. The adjustment device of claim 1, further comprising:

a pair of wings joined by a first base in a generally U-shaped configuration, the pair of wings and the first base substantially forming the seat support;

a pair of appendages protruding below the wings, respectively, wherein the appendages comprise holes formed along a single axis; and a pair of first cylindrical shafts that protrude beyond terminal ends of the appendages, respectively, the pair of first cylindrical shafts rotatably coupled to the base portion of the base support by interposition of sleeves arranged near the holes.

3. The adjustment device of claim 2, wherein a first terminal of the first handle is disposed coaxially to one of the first cylindrical shafts near one of the appendages.

4. The adjustment device of claim 3, wherein the selection of the angular position of the adjustment device is performed by a first ring disposed coaxially to one of the first cylindrical shafts near the first terminal, wherein the first ring is integral with one of the first cylindrical shafts through one or more screws arranged along a diameter-based axis on the first ring.

5. The adjustment device of claim 4, wherein a pair of first seats for a pair of switches are obtained on an axis rotated approximately 90° on said first ring, slideably associated in contrast with a pair of first springs.

6. The adjustment device of claim 5, wherein, when said switches extend beyond an outer lateral surface of said first ring, the switches selectively interact with molded seats positioned on an axially inner lateral surface of the first handle.

7. The adjustment device of claim 6, wherein said inner surface has a diameter about equal to an exterior of said first ring and, through said switches, is coupled to said first ring positioned close to said first terminal.

8. The adjustment device of claim 7, wherein said first terminal is made integral in rotation with said first handle, while it is neutral with respect to said first shaft through a protrusion projecting axially to said first terminal and shaped so as to be positioned between said molded seats.

9. The adjustment device of claim 8, wherein said rotation of said first handle is obtained through the interaction of said switches with said molded seats.

10. The adjustment device of claim 8, wherein said protrusion is elastically deformable to define an elastic connection with said first handle.

11. The adjustment device of claim 10, wherein, coaxially to said first terminal, the first tensional element comprises a cable at one end made integral with said first terminal itself, wherein the rotation imposed on said first handle generates traction of said cable that interacts with a guide protruding from a side wall of said base portion of the base support.

12. The adjustment device of claim 11, wherein said guide, concealed by a first cap, directs said first cable to a third seat positioned across said base support in an area adjoining said base portion, wherein the stroke limiter is slidably positioned within said third seat and the stroke limiter includes a rectangular element with a stepped shape decreasing in height.

13. The adjustment device of claim 12, wherein the stroke limiter is directionally biased within the third seat by a second spring that works in compression, and wherein said stepped shape selectively interacts with the limit switch that is configured as a hammer-shaped appendage protruding internally and under said first base of said seat support.

14. The adjustment device of claim 13, wherein the torsion bar is tied at one end of said first shaft that supports said first handle and the other end of the torsion bar is tied to said first shaft.

15. The adjustment device of claim 14, wherein said torsion bar cooperates with a crank associated with a rotating second pair of appendages protruding perpendicularly from a first wing of the pair of wings, said crank having a worm gear that interacts with a gear placed across the worm, said gear is swivel-hinged near a plate connecting the second appendages, said gear having a threaded shank protruding toward said first base and interacting with a slider slideably associated with a second guide obtained lower and axially along said first wing.

16. The adjustment device of claim 15, wherein said slider moves away from said plate towards said first base following a rotation imposed on said crank, said slider includes, at an end opposite to said plate, an inclined surface that forms, with respect to a plane of position of said first wing, an acute angle.

17. The adjustment device of claim 16, wherein a pin is slideably placed transversely to said inclined surface and connected through curve-shaped appendages, which are coaxially integral to said first shaft, the shape of said inclined surface determining a rotation of said third appendages which, being fixed to said first shaft, cause a preload to said torsion bar.

18. The adjustment device of claim 17, wherein the second handle is coupled with a second ring, coaxial to said first shaft and integral in rotation with the third appendage, said second ring presenting a protrusion for coupling to said second handle, which acts as a safety clutch.

* * * * *